United States Patent [19]

Singer

[11] 4,292,352

[45] Sep. 29, 1981

[54] REMOVABLE GLASS DESK PAD

[76] Inventor: Larry Singer, 1758 S. Preuss Rd., Los Angeles, Calif. 90035

[21] Appl. No.: 120,042

[22] Filed: Feb. 11, 1980

[51] Int. Cl.[3] ..... A47G 1/06; A47G 23/03

[52] U.S. Cl. ..... 428/14; 40/158 R; 156/60; 428/193

[58] Field of Search ..... 428/14; 248/346; 40/152, 358, 158 R; 156/107, 293, 304.1; 46/20

[56] References Cited

U.S. PATENT DOCUMENTS

| | | | |
|---|---|---|---|
| 250,576 | 12/1881 | Read, Jr. | 428/14 |
| 368,490 | 8/1887 | Philion | 156/304.1 X |
| 1,506,215 | 8/1924 | Beshgetoor | 40/158 R |
| 3,886,677 | 6/1975 | Behring et al. | 428/14 X |
| 4,030,236 | 6/1977 | Schnabel | 46/20 X |
| 4,066,489 | 1/1978 | Hannum et al. | 156/304.1 X |
| 4,082,875 | 4/1978 | Citron | 428/14 X |
| 4,189,857 | 2/1980 | Fujisawa | 40/158 R |

*Primary Examiner*—Henry F. Epstein

*Attorney, Agent, or Firm*—Thomas I. Rozsa

[57] ABSTRACT

The present invention relates to an improved desk pad wherein the border of the desk pad is made of lightweight material but is so constructed as to have sufficient strength to support a removable glass plate in the central area of the pad and within the border.

6 Claims, 5 Drawing Figures

REMOVABLE GLASS DESK PAD

BACKGROUND OF THE INVENTION

Accessories for use as writing surfaces in conjuction with desks have been in use for many years. One method of protecting the surface of a desk or table is through the use of a desk pad which is placed on the surface to be protected. The individual places the material on which he will write directly on the desk pad, thereby preventing direct contact between the material on which the writing or drawing is performed and the table or desk surface to be protected.

Desk pads have been known in the office supply business for many years and have been produced in many varied configurations and materials. It is well known to use paper or cardboard for the flat surface of the desk pad and to use a heavier stock of paper or cardboard attached to the lengthwise or widthwise ends of the desk pad for use as lengthwise or widthwise borders.

Other material such as wood, plastic, or marble have also been used to form either or both the flat surface or the borders of the desk pad.

Though usually rectangular, it is well known to form the shape of a desk pad in many other configurations such as square circular or oval.

The construction of desk pads in the prior art consists of attaching thickened pieces of material such as cardboard or wood directly to the edge of the flat surface to form a border to the desk pad. While this method provides aesthetic beauty to the design, it does not provide support strength to the desk pad itself. Prior art designs have accommodated a thin plastic sheet which may be placed over the flat surface of the pad and whose edges may be tucked into a groove between the lower surface of the border and the flat surface of the desk pad. Prior art designs however are not capable of accommodating or supporting anything heavier than a thin plastic sheet over the flat surface of the desk pad.

SUMMARY OF THE PRESENT INVENTION

It has been discovered, according to the present invention, that when using paper or cardboard for the border of the desk pad, by creating a border to the desk pad in which the elongated edge of a border strip is set at ninety degrees (90°) to and directly against the shorter edge of a border strip so as to create a rectangular configuration by using four such strips placed together as described and by placing several layers of strips one above the other but with each successive layer offset from the previous layer by the width of the border, the border is vastly strengthened so as to enable it to support items heavier than a thin plastic sheet.

It has also been discovered, according to the present invention, that by using a glass plate to cover the flat surface of the desk pad, the aesthic design of the desk pad is vastly improved, the glass provides a very smooth surface on which to write, and the glass provides a means for placing material such as a calendar, notes, or pictures between the upper flat surface of the desk pad and the lower surface of the glass so that such material is clearly visible while not obstructing the writing surface of the glass plate. A glass plate cannot be used with paper or cardboard desk pads of conventional design because they do not have sufficient strength to hold and support a heavy material such as glass. The present invention provides a novel means for obtaining sufficient strength on a paper or cardboard desk pad to hold and support a heavy material such as glass.

It is therefore an object of the present invention to provide a means for increasing the holding and support strength of a paper or cardboard desk pad.

It is a further object of the present invention to provide an apparatus which has increased strength while using light paper or cardboard for a desk pad.

It is still another object of the present invention to provide a lightweight desk pad which is capable of supporting a glass plate in its central portion on which writing may be performed and beneath which pictures, calendars or other objects may be easily placed and viewed without obstructing the writing surface.

Further novel features and other objects of the present invention will become apparent from the following detailed description, discussion and the appended claims taken in conjunction with the drawings.

DRAWING SUMMARY

Referring particularly to the drawings for the purposes of illustration only and not limitation there is illustrated:

DETAILED DESCRIPTION OF THE PREFERRED EMBODIMENT

Figure 1:
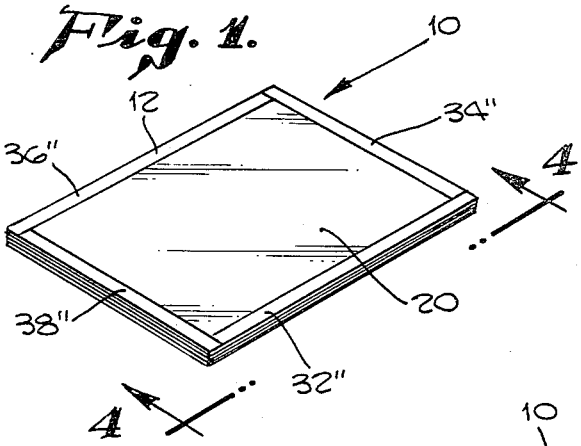
FIG. 1 is a perspective view of the Improved Removable Glass Desk Pad.
Figure 2:
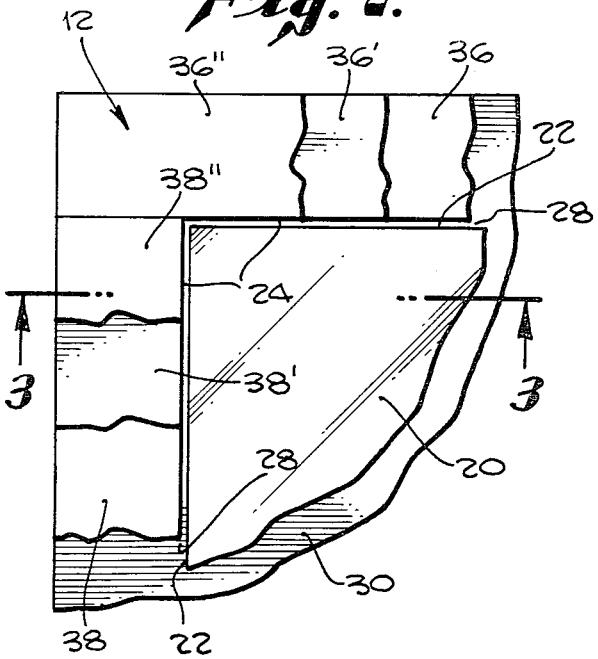
FIG. 2 is a fragmentary plan elevational view of a typical corner of the Improved Removable Glass Desk Pad.

With reference to the drawings of the invention in detail and more particularly to FIG. 1, there is shown at 10 the Improved Removable Glass Desk Pad. The top portion of the border of the present invention is shown at 12 and the upper surface of the glass plate which lies within the central area of the present invention is shown at 20. As shown in FIG. 2, the external circumference 22 of the glass plate 20 is separated from the internal circumference 24 of the border 12 by a gap 28.

Figure 5:
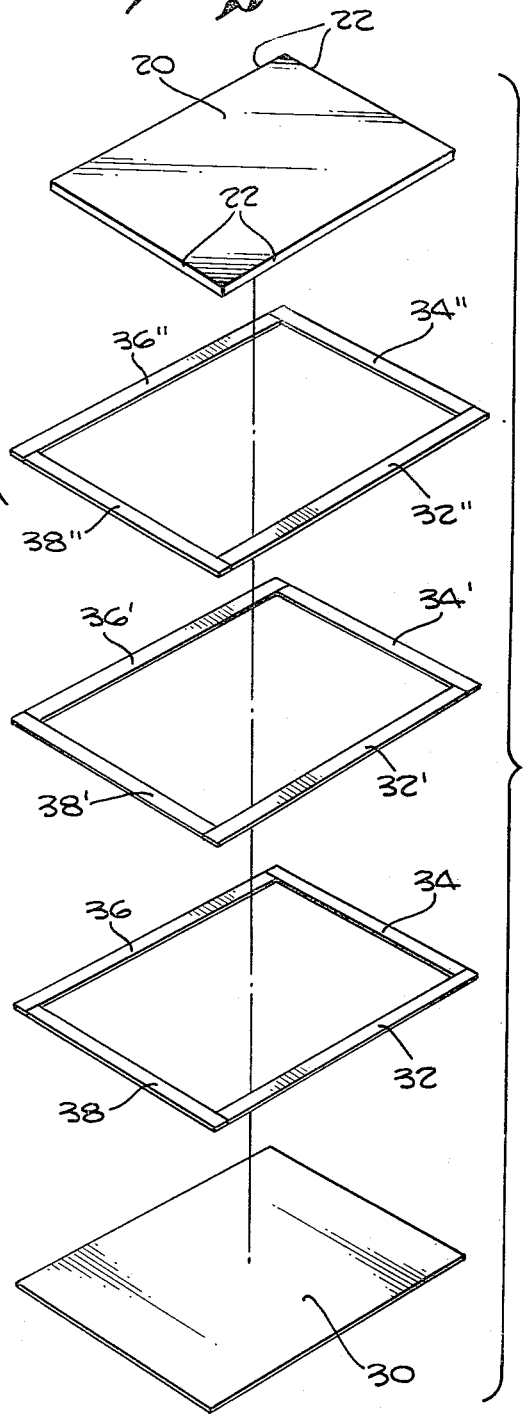
FIG. 5 is an exploded view of the parts of the Improved Removable Glass Desk Pad.

A detailed presentation of the construction of the present invention is shown in the exploded view of the parts of the Improved Removable Desk Pad presented in FIG. 5. The base of the present invention is shown at 30 and is a solid flat rectangular piece of material such as cardboard, chipboard, vinyl or heavy paper. The lowermost layer of the border 12 is formed in four sections, shown at 32,34,36 and 38in FIG. 5. Each section is firmly secured to the base 30 by conventional means such as glue. The section 32 extends lengthwise along the forward lengthwise portion of the present invention, beginning at a distance which is set inward from one widthwise portion of the present invention a distance equivalent to the width of the border and running the remainder of the length of the forward lengthwise portion of the base 30. The second section 34 extends widthwise along the right widthwise portion of the present invention, beginning at the inner portion of lengthwise border section 32 and running the remainder of the width of the right widthwise portion of the base 30. The third section 36 extends lengthwise along the rearward portion of the present invention, beginning at the inner portion of the widthwise border section 34 and running the remainder of the length of the rearward lengthwise portion of the base 30. Finally, the fourth section 38 extends along the left widthwise portion of the present invention, beginning at the inner portion of the lengthwise border section 36 and running the remainder of the width of the left widthwise portion of the base 30, thereby completing the circumference of the base. In each case, the outer edge of a section 32, 34, 36 and 38 is aligned with the outer edge of the border 30 along which each respective section runs and the widthwise portion of said border section is aligned with the edge of the border 30 which is perpendicular to the lengthwise portion of that section. Each section can be made of material such as cardboard, chipboard, vinyl or heavy paper. By way of illustration only, if the length of the base 30 is twenty-six (26) inches and the width of the base 30 is seventeen (17) inches then the width of each border section 32,34,36 or 38 can be one and a half ($1\frac{1}{2}$) inches.

The second layer of the border 12 is also formed in four sections, shown at 32',34',36', and 38' in FIG. 5. The four sections 32',34',36' and 38' overlap the corresponding sections 32,34, 36 and 38 of the lowermost layer with one variation. Each section of the second layer is offset from the lowermost layer by the width of each border. Therefore, section 32' begins at the left widthwise border of the present invention, extends lengthwise along the forward lengthwise portion of the present invention and ends at a distance from the right widthwise border of the present invention which is equivalent to the width of the border 34'. The border 34' begins at the forward lengthwise portion of the present invention, has its inner lengthwise border placed against the edge of the border 32' and extends lengthwise along the right widthwise portion of the present invention and ends at a distance from the rearward border of the present invention which is equivalent to the width of the border 36'. In the same fashion, border 36' extends along the rearward lengthwise portion of the present invention and border 38' extends along the left widthwise portion of the present invention. The border section 32', 34', 36' and 38' are attached to corresponding border section 32, 34, 36 and 38 by conventional means such as glue.

A third layer of the border 12 is also formed in four sections 32", 34", 36" and 38" whose placement exactly corresponds to the placement of the lowermost layer border sections 32,34,36 and 38. Successive layers are added in this fashion with each successive layer offset from the layer beneath it by the width of the border. The top portion of the border 12 can be of one piece construction and cover the length and width of all four border section groups beneath it or it can be four sections as shown in FIG. 5.

The glass plate 20 is then removably placed inside the recessed area formed by the interior portion of the base 30 at the bottom and by the inner edges of the border sections around the circumference. In order to have the required strength, at least three layers of border sections are required to provide sufficient strength; however the number of layers is not limited and any number of layers can be used to form the required thickness to accommodate the thickness of the glass plate 20. The thin gap 28 between the edge of the glass plate 20 and the inner edges of the border sections is required to enable material to be slid underneath the glass. It is desirable, although not required, to have the thickness of the border equal to the thickness of the glass plate so that the upper surfaces of the border and the glass plate are in alignment.

Figure 3:
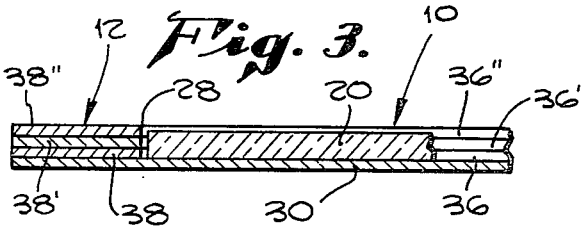
FIG. 3 is a cross-sectional view taken along line 3—3 of FIG. 2.
Figure 4:
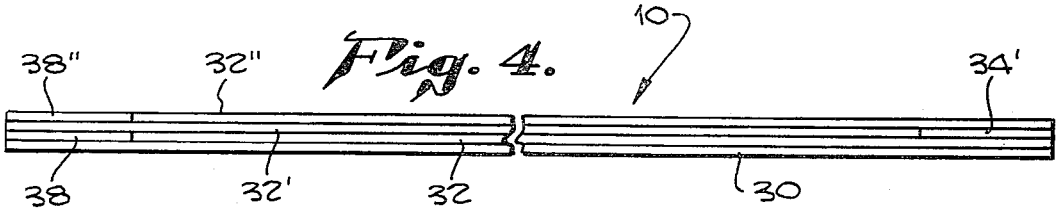
FIG. 4 is a front elevational view taken along line 4—4 of FIG. 1.

The construction as described above is further illustrated in the cross-sectional view shown in FIG. 3 and the front elevational view shown in FIG. 4.

The use of this novel construction technique allows the border section 32, 34, 36 and 38 and corresponding upper border sections to be made of relatively lighweight material while still being capable of supporting a heavy material such as the glass plate 20 in the central portion of the desk pad. In conventional desk pads, a simple one strip border or a border made by having multiple strips of material placed directly over each other and not offset, provides a weak structure which is not capable of supporting heavy material such as the glass plate.

A further novel feature of the present invention is the use of the glass plate in the central portion. By using the glass plate, a smooth writing surface is provided. The use of glass also provides a clean surface beneath which may be placed a calender, notes, pictures, or other material which will not interfere with the smooth upper surface of the glass.

An additional novel feature of the present invention is the method of using lightweight material in such a fashion as to provide a strong support border for the heavy glass plate.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the methods shown are intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An improved removable glass desk pad comprising:

a. a rectangular base member;

b. a rectangular border member rigidly attached to one surface of said base member;

c. said rectangular border member constructed of multiple layers wherein the lowermost layer consists of four elongated sections of equal width arranged so that one widthwise portion of each section abuts and is perpendicular to the lengthwise portion of an adjacent section such that the four sections form a rectangle whose outer circumference is aligned with the circumference of said base member, wherein the second layer of four sections is arranged so that each section is aligned with the corresponding section directly beneath it but offset in its lengthwise direction by a distance equivalent to the width of the section, wherein the four sections of the third layer are in direct alignment with the four sections of the lowermost layer, and each successive layer is so arranged that the four sections of that layer are in direct alignment with the four sections of the layer two levels below, such that a rectangular border is formed wherein the circumference of the outer edge of the layers of sections is aligned with the circumference of said base member and the inner edge of the layer of sections combine to form a recessed area within the central portion of said desk pad;

d. said lowermost layer of sections being rigidly attached to said base member and each successive layer of sections being rigidly attached to the corresponding layer of sections directly beneath it; and e. a glass plate removably placed on top of said base member and within said recess created by said rectangular border member such that the circumference of the glass plate is only slightly smaller than the inner circumference of said rectangular border member.

2. An improved removable glass desk pad as defined in claim 1 wherein said rectangular base member is made of chip board and said sections of said rectangular border member are made of chip board.

3. An improved removable glass desk pad as defined in claim 1 wherein said rectangular base member is made of cardboard and said sections of said rectangular border member are made of paper.

4. The method of using lightweight material on the border of a desk pad to support a heavier material within the central portion of the desk pad comprising the steps of:

a. utilizing a solid rectangular material as a base member;

b. constructing a rectangular border rigidly attached to one surface of said base member by placing multiple layers of four elongated sections of equal width per layer arranged so that one widthwise portion of each section abuts and is perpendicular to the lengthwise portion of an adjacent section such that the four sections in a layer form a rectangle whose outer circumference is aligned with the circumference of said base material and wherein the four sections of a layer are exactly aligned with the four sections of a layer two levels below while the sections of the layer in direct contact with a successive layer have the lengthwise portion of each section offset from each corresponding section in a successive layer by a distance equivalent to the width of a section; and c. rigidly attaching each layer to the successive layer beneath it.

5. A desk pad having a removable plate therein, comprising:

a. a rectangular base member;

b. a border assembly containing several sets of members, wherein each set forms a rectangular loop structure consisting of four elongated flat members placed around the circumference of said rectangular base member and secured thereto such that the four members form a rectangle whose outer circumference is aligned with the circumference of said base member and one widthwise portion of each member abuts and is perpendicular to the lengthwise portion of an adjacent member;

c. said set of members placed on top of each other to form a laminated structure wherein each member is aligned with the corresponding member directly beneath it but offset in its lengthwise direction by a distance equivalent to the width of the member and wherein each member is in direct alignment with the member located two levels below it;

d. the interior boundary of said border assembly forming a circumferentially enclosed recess therein; and e. a rectangular glass plate removably placed on top of said base member and within said recess such that the dimensions of said glass plate are only slightly smaller than the inner dimensions of said border assembly.

6. A desk pad having a removable plate therein as defined in claim 5 wherein said rectangular base member is made of cardboard and said members of said border assembly are made of cardboard.

* * * * *